US009748691B2

(12) United States Patent
Soubh et al.

(10) Patent No.: US 9,748,691 B2
(45) Date of Patent: Aug. 29, 2017

(54) LATCH ASSEMBLY FOR LOW-PROFILE RIGHT-ANGLE ELECTRICAL CONNECTOR

(71) Applicant: AirBorn, Inc., Georgetown, TX (US)

(72) Inventors: Emad Soubh, Camas, WA (US); Jason Smith, Sartell, MN (US); John Grant, Sherborn, MA (US)

(73) Assignee: AIRBORN, INC., Georgetown, TX (US)

( * ) Notice: Subject to any disclaimer, the term of this patent is extended or adjusted under 35 U.S.C. 154(b) by 0 days.

(21) Appl. No.: 15/156,283

(22) Filed: May 16, 2016

(65) Prior Publication Data

US 2016/0261067 A1 Sep. 8, 2016

Related U.S. Application Data

(63) Continuation of application No. 14/317,764, filed on Jun. 27, 2014, now Pat. No. 9,343,845, which is a continuation of application No. 13/675,955, filed on Nov. 13, 2012, now Pat. No. 8,784,122, which is a continuation-in-part of application No. 13/296,166, filed on Nov. 14, 2011, now Pat. No. 8,435,074, and a continuation-in-part of application No. 13/296,174, filed on Nov. 14, 2011, now Pat. No. 8,597,047, and a continuation-in-part of application No. 13/296,179, filed on Nov. 14, 2011, now abandoned.

(51) Int. Cl.

| | |
|---|---|
| ***H01R 13/62*** | (2006.01) |
| ***H01R 13/627*** | (2006.01) |
| ***H01R 12/72*** | (2011.01) |
| ***H01R 25/00*** | (2006.01) |
| ***H01R 12/70*** | (2011.01) |
| ***H01R 12/71*** | (2011.01) |

(52) U.S. Cl.

CPC ..... *H01R 13/6275* (2013.01); *H01R 12/7082* (2013.01); *H01R 12/716* (2013.01); *H01R 12/724* (2013.01); *H01R 13/627* (2013.01); *H01R 25/006* (2013.01)

(58) Field of Classification Search

CPC ..... H01R 13/6275

See application file for complete search history.

(56) References Cited

U.S. PATENT DOCUMENTS

| | | | | |
|---|---|---|---|---|
| 4,984,992 | A | 1/1991 | Beamenderfer et al. | |
| 5,385,490 | A | 1/1995 | Demeter et al. | |
| 5,838,550 | A * | 11/1998 | Morris | H01R 13/65802 174/376 |
| 6,102,747 | A | 8/2000 | Paagman | |
| 6,155,887 | A | 12/2000 | Cuff | |
| 6,220,869 | B1 | 4/2001 | Grant | |

(Continued)

*Primary Examiner* — Ross Gushi

(74) *Attorney, Agent, or Firm* — Locke Lord LLP

(57) ABSTRACT

A low-profile, right angle connector assembly comprises six cable connectors and six board-mount connectors housed within a PCIe bracket and EMI shell. The PCIe bracket and EMI shell are braced to a low profile PCIe card. Each board-mount connector is designed to receive a cable connector and allows for the transmission and processing of high-speed data with lower latency. A removable latch mounted on the cable connectors helps ensure the cable connectors remain physically connected to the board-mount connectors. The removable latch may be replaced as needed for breakage and wear and tear.

9 Claims, 14 Drawing Sheets

(56) References Cited

U.S. PATENT DOCUMENTS 6,257,935 B1 * 7/2001 Zhang ..... H01R 24/64 439/676
6,273,762 B1 8/2001 Regnier
6,318,632 B1 11/2001 Grant
6,361,374 B1 3/2002 Lloyd et al.
6,623,300 B2 9/2003 Sakurai et al.
6,685,510 B1 2/2004 Wu
6,699,072 B1 3/2004 Wu
6,699,073 B1 3/2004 Wu
6,736,663 B2 * 5/2004 Lee ..... H01R 13/6275 439/353
6,739,910 B1 5/2004 Wu
6,743,050 B1 6/2004 Wu
6,780,069 B2 8/2004 Scherer et al.
6,831,840 B2 12/2004 Ruff
6,835,086 B1 * 12/2004 Tsai ..... H01R 13/6395 439/354
6,857,912 B2 2/2005 Wu
6,870,746 B2 3/2005 Leeson et al.
6,877,992 B2 4/2005 Grant
6,926,553 B2 8/2005 Wu
6,939,174 B2 9/2005 Wu
7,021,942 B2 4/2006 Grant
7,134,913 B1 11/2006 Hasircoglu et al.
7,187,076 B2 3/2007 Cuff
D543,508 S 5/2007 Dever
D549,659 S 8/2007 Dever
7,273,391 B2 9/2007 Purwin
D560,613 S 1/2008 McEvoy
D560,614 S 1/2008 McEvoy
D561,103 S 2/2008 Grant
D561,107 S 2/2008 Cuff
D561,108 S 2/2008 Cuff
D561,109 S 2/2008 Howerton
D561,110 S 2/2008 Howerton
D561,698 S 2/2008 Cuff
D562,248 S 2/2008 Howerton
D562,249 S 2/2008 Howerton
D562,775 S 2/2008 Cuff
D563,877 S 3/2008 Grant
D563,878 S 3/2008 Grant
D563,879 S 3/2008 Grant
D563,881 S 3/2008 Howerton et al.
D563,882 S 3/2008 Howerton et al.
D563,883 S 3/2008 Dever
D563,884 S 3/2008 Dever
D563,885 S 3/2008 Dever
D563,886 S 3/2008 Dever
D563,887 S 3/2008 Dever
7,364,441 B2 4/2008 Le et al.
7,422,490 B2 9/2008 Droesbeke et al.
7,485,012 B2 2/2009 Daugherty et al.
7,651,359 B2 1/2010 Scherer et al.
7,713,066 B2 5/2010 Hass
7,744,385 B2 6/2010 Scherer
7,744,414 B2 6/2010 Scherer et al.
7,798,821 B2 9/2010 Liu et al.
7,871,296 B2 1/2011 Fowler et al.
8,210,876 B2 7/2012 Derks et al.
8,449,330 B1 5/2013 Schroll et al.
2002/0111067 A1 8/2002 Sakurai et al.
2004/0110420 A1 6/2004 Wu
2004/0115983 A1 * 6/2004 Liang ..... H01R 13/6474 439/344
2004/0259420 A1 12/2004 Wu
2006/0105597 A1 5/2006 Purwin
2007/0099475 A1 5/2007 Le et al.
2008/0009191 A1 1/2008 Van Den Heuvel et al.
2008/0182456 A1 7/2008 Zhang
2009/0215318 A1 8/2009 Hass
2009/0233480 A1 9/2009 Feldman et al.
2010/0009571 A1 1/2010 Scherer et al.
2011/0294309 A1 12/2011 Chen et al.

* cited by examiner

LATCH ASSEMBLY FOR LOW-PROFILE RIGHT-ANGLE ELECTRICAL CONNECTOR

CROSS REFERENCE TO RELATED APPLICATIONS

This application for patent is a continuation of U.S. patent application Ser. No. 14/317,764, entitled "Latch Assembly for Low-Profile Right-Angle Electrical Connector," filed Jun. 27, 2014, which is a continuation of U.S. patent application Ser. No. 13/675,955 (now U.S. Pat. No. 8,784,122), entitled "Low-Profile Right-Angle Electrical Connector Assembly," filed Nov. 13, 2012, which is a continuation-in-part of U.S. patent application Ser. No. 13/296,166 (now U.S. Pat. No. 8,435,074), entitled "Low-Profile Right-Angle Electrical Connector Assembly," filed Nov. 14, 2011; and a continuation-in-part of U.S. patent application Ser. No. 13/296,174 (now U.S. Pat. No. 8,597,047), entitled "Insulator with Air Dielectric Cavities for Electrical Connector," filed Nov. 14, 2011; and a continuation-in-part of U.S. patent application Ser. No. 13/296,179, entitled "Electrical Connector with Wafer Having Inwardly Biasing Dovetail," filed Nov. 14, 2011; all of which are incorporated herein by reference in their entireties.

BACKGROUND OF THE INVENTION

Field of Invention

The present invention is directed to a low-profile right angle electrical connector assembly having six board-mount connectors that allow for the right angle connection of cable connectors to a low profile Peripheral Component Interconnect Express ("PCIe") card such that the assembly has a total of 48 differential pairs of signal contacts capable of carrying multi-gigabit per second serial bus signals (such as HyperTransport® and/or PCIe Gen-III) with high signal fidelity. In some embodiments, each cable connector includes a replaceable latch that helps secure the cable connectors relative to the board-mount connectors.

Description of Related Art

Traditional low-profile PCIe card connector assemblies only contain four board-mount connectors because the connectors are too large to allow six connectors to fit in the space required by the PCIe specification. Even with eight differential pairs per connector, these other connector assemblies would only have a total of thirty-two differential pairs, which means that each connector assembly would have a maximum of 16 lanes PHY per low-profile PCIe form factor card. These traditional connector assemblies result in undesirable latency (i.e., reduction in the speed and processing of data) and cannot be used to create complex topologies like 3D Torus or Flat Butterfly networks because these multidimensional network topologies need 24 lanes of signals, i.e. a total of 48 differential pairs of signal contacts. 3D Torus networks and other multidimensional topologies allow for energy-proportional computing and enable a reduction of the server's interconnection energy consumption of approximately one-fourth of the consumption of the traditional switched networks. Considering that most modern servers used in datacenters are designed to accommodate only low-profile PCIe cards, using standard connectors would not enable the realization of the type of power reduction and efficiency improvements afforded by low-profile PCIe with a total of 48 differential pairs of signal contacts.

Thus, there is a need in the art for a PCIe card assembly with an increased number of board-mount connectors that allow for the secure right angle connection to a corresponding number of cable connectors while maintaining signal fidelity and meeting the low-profile PCIe card requirements.

SUMMARY

Embodiments of the invention provide a low-profile right-angle connector assembly with six board-mount connectors that allow cable connectors to connect to a low-profile PCIe card. The six board-mount connectors are housed within a PCIe bracket and a cover or shell, which may be an electro-magnetic interference ("EMI") shielding shell in some embodiments, that are braced to the low profile PCIe card. Each of the six board-mount connectors has eight differential pairs for a total of 48 differential pairs compared to conventional four-connector arrangements that contain only 32 differential pairs. The use of six board-mount connectors allows for the implementation of complex 3D interconnection topologies, reduces the diameter of the network, and enables more servers to be reached with fewer hops relative to implementations that use four connectors and 2D topologies, resulting in greater performance, lower latency, and cost benefits. Additionally, in some embodiments, an LED display of the link status may be provided, which can be an important factor for system administrators in a complex network topology scenario. The various embodiments of the invention allow improved capabilities and efficiencies, particularly when used with standard high density servers, including switchless large direct connect topologies, lower infrastructure cost, lower power consumption, lower operation costs, simplified cabling compared with traditional connectors, improved fault tolerance, and improved reliability.

In general, in one aspect, embodiments of the invention relate to an electrical connector assembly affording a right angle electrical connection to a low profile PCIe printed circuit board. The connector assembly comprises, among other things, at least one board-mount connector, at least one cable connector detachably coupled to the at least one board-mount connector, and a PCIe bracket, wherein the at least one board-mount connector contains a total of forty-eight differential signal pairs.

In some embodiments, the differential signal pairs are pin contacts. In some embodiments, the differential signal pairs are socket contacts. In some embodiments, the at least one cable connector is a male connector having pin contacts. In some embodiments, the at least one cable connector is a female connector having socket contacts.

In some embodiments, the at least one board-mount connector comprises seven overmolded lead frame assemblies. In some embodiments, each one of the seven overmolded lead frame assemblies comprises a lead frame and a pin wafer. In some embodiments, each one of the seven overmolded lead frame assemblies comprises a lead frame and a socket wafer. In some embodiments, the seven overmolded lead frames assemblies further comprise a depression.

In some embodiments, the at least one board-mount connector comprises an LED. In some embodiments, the at least one cable connector comprises a latch. In some embodiments, the at least one cable connector comprises a ground strap having three ground tabs and secures two cable members together.

In general, in another aspect, embodiments of the invention relate to an electrical connector assembly having a latch. The electrical connector assembly comprises, among other things, a board-mount connector, a cable connector configured to be detachably coupled to the board-mount connector, and a connector cover substantially enclosing the board-mount connector, the connector cover having a receptacle housing configured to receive the cable connector. The electrical connector assembly further comprises a latch attached to the cable connector, the latch configured to releasably engage the receptacle housing of the connector cover to secure the cable connector relative to the board-mount connector.

In some embodiments, the receptacle housing of the connector cover includes a latch opening and the latch includes a latch stop configured to engage a leading edge of the latch opening. In some embodiments, the cable connector includes a latch anchor and the latch includes an anchor tab configured to removably engage the latch anchor of the cable connector to releasably secure the latch relative to the cable connector. In some embodiments, the cable connector includes one or more hook supports and the latch includes one or more hooks configured to removably engage the one or more hook supports to releasably secure the latch relative to the cable connector. In some embodiments, the cable connector includes one or more slots and the latch includes one or more guide tabs configured to removably engage the one or more slots to releasably secure the latch relative to the cable connector. In some embodiments, the connector cover is made of a material that helps protect the board-mount connector from electromagnetic interference.

In general, in another aspect, embodiments of the invention relate to an electrical connector having a latch. The electrical connector comprises, among other things, a cable connector, a latch anchor formed on the cable connector, a latch attached to the cable connector, and an anchor tab formed in the latch, the anchor tab configured to engage the latch anchor to releasably secure the latch to the cable connector.

In some embodiments, the latch includes a head section and a base section generally parallel to one another and further includes a body section forming an interconnecting diagonal therebetween. In some embodiments, the anchor tab is formed in the body section of the latch and includes an anchor opening, the anchor opening having a size and shape to provide a precise fit around the latch anchor to releasably secure the latch to the cable connector. In some embodiments, the latch anchor includes an inclined surface configured to allow the anchor tab to be slid up the inclined surface. In some embodiments, in the head section of the latch includes an ovoid latch stop formed therein. In some embodiments, the cable connector includes two parallel longitudinally extending ridges and the latch is disposed between the parallel longitudinally extending ridges.

Additional and/or alternative aspects of the invention will become apparent to those having ordinary skill in the art from the accompanying drawings and following detailed description of the disclosed embodiments.

BRIEF DESCRIPTION OF THE DRAWINGS

The apparatus of the invention is further described and explained in relation to the following figures of the drawing wherein.

DETAILED DESCRIPTION OF THE PREFERRED EMBODIMENTS

The figures described above and the written description of specific structures and functions below are not presented to limit the scope of what Applicants have invented or the scope of the appended claims. Rather, the figures and written description are provided to teach any person skilled in the art to make and use the inventions for which patent protection is sought. Those skilled in the art will appreciate that not all features of a commercial embodiment of the inventions are described or shown for the sake of clarity and understanding. Persons of skill in this art will also appreciate that the development of an actual commercial embodiment incorporating aspects of the present inventions will require numerous implementation-specific decisions to achieve the developer's ultimate goal for the commercial embodiment. Such implementation-specific decisions may include, and likely are not limited to, compliance with system-related, business-related, government-related and other constraints, which may vary by specific implementation, location, and from time to time. While a developer's efforts might be complex and time-consuming in an absolute sense, such efforts would be, nevertheless, a routine undertaking for those of skill in this art having benefit of this disclosure. It must be understood that the inventions disclosed and taught herein are susceptible to numerous and various modifications and alternative forms. Lastly, the use of a singular term, such as, but not limited to, "a," is not intended as limiting of the number of items. Also, the use of relational terms, such as, but not limited to, "top," "bottom," "left," "right," "upper," "lower," "down," "up," "side," and the like are used in the written description for clarity in specific reference to the figures and are not intended to limit the scope of the invention or the appended claims.

Figure 1:
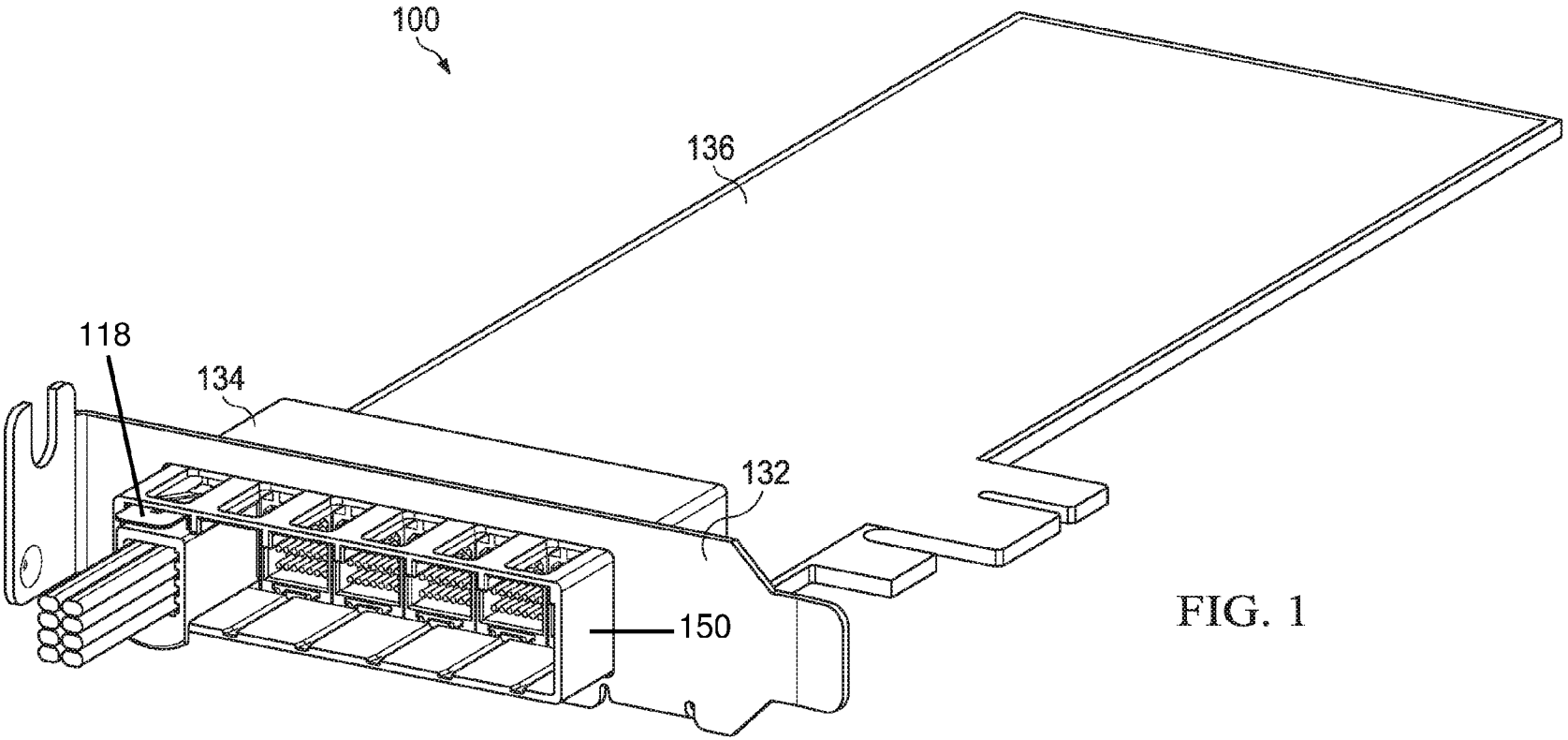
FIG. 1 is a top perspective view of the low-profile right-angle connector assembly with one cable connector plugged into one of six board-mount connectors.
Figure 2:
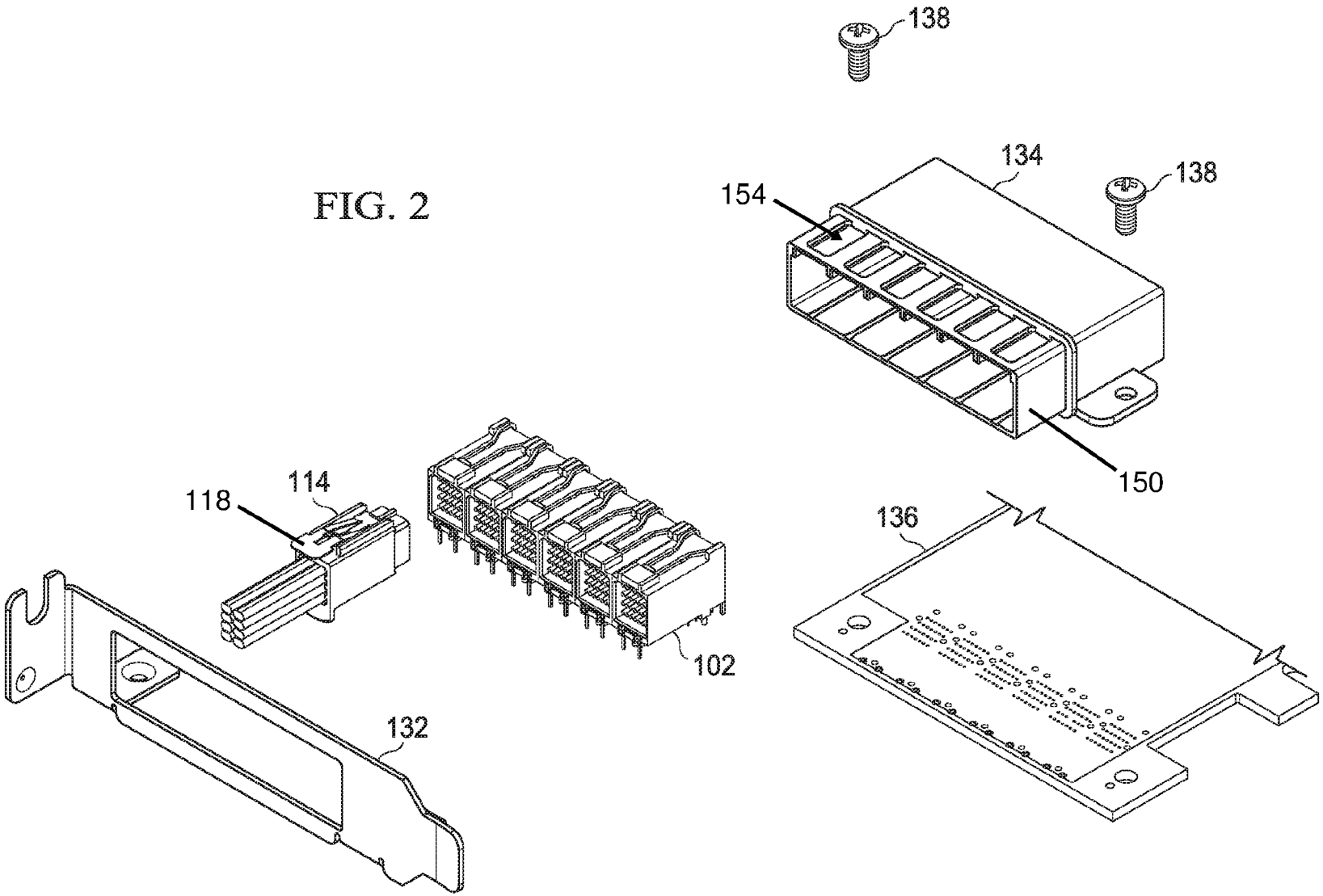
FIG. 2 is an exploded top perspective view of the low-profile right-angle connector assembly.
Figure 3:
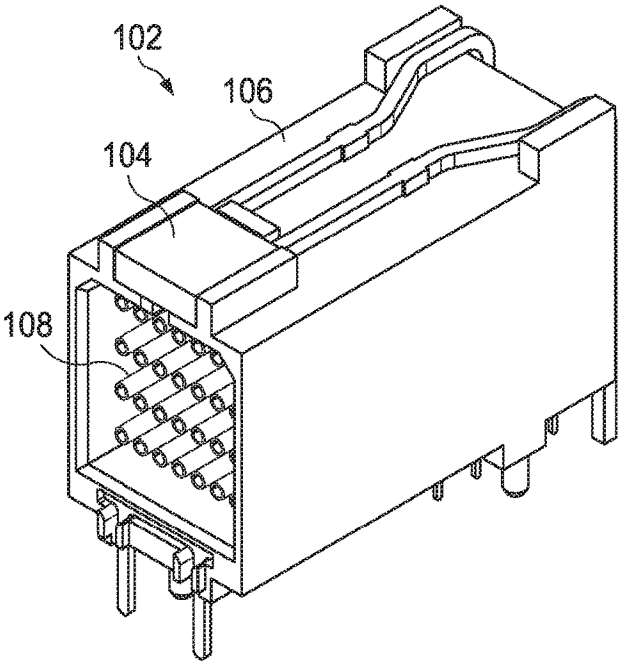
FIG. 3 is a top perspective view of a board-mount connector and a cable connector in mating orientation.
Figure 3:
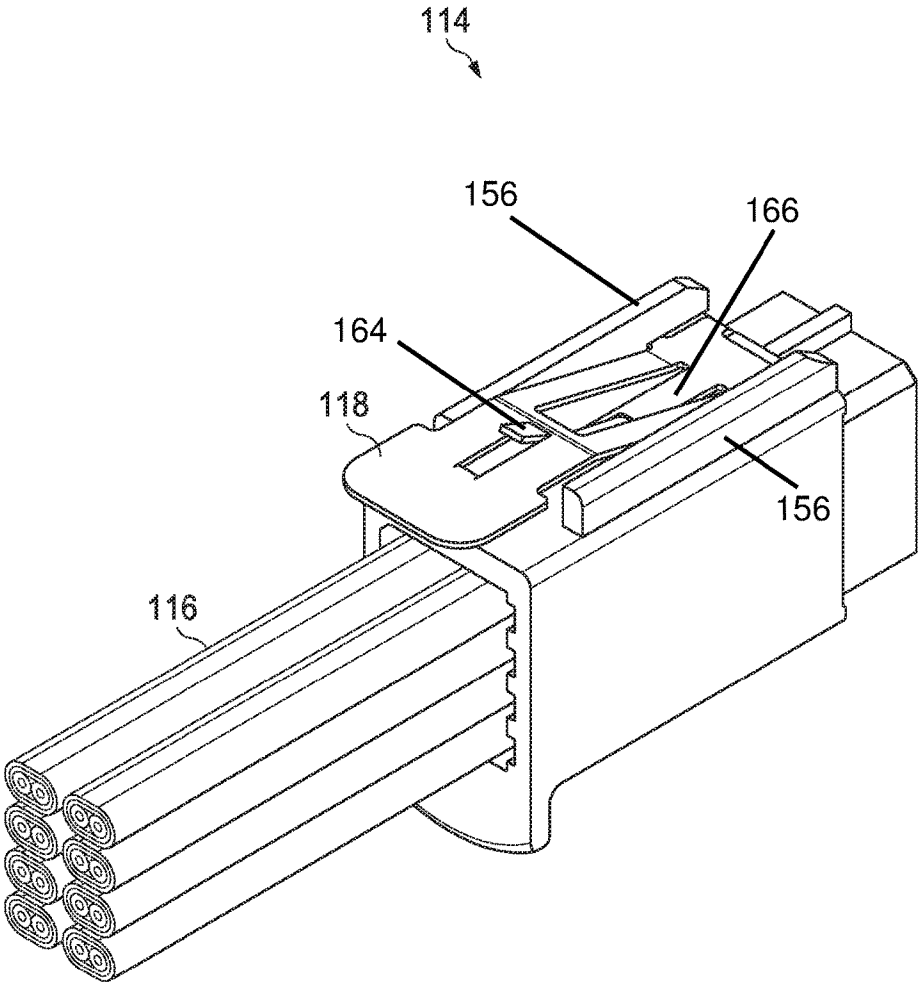
Figure 5:
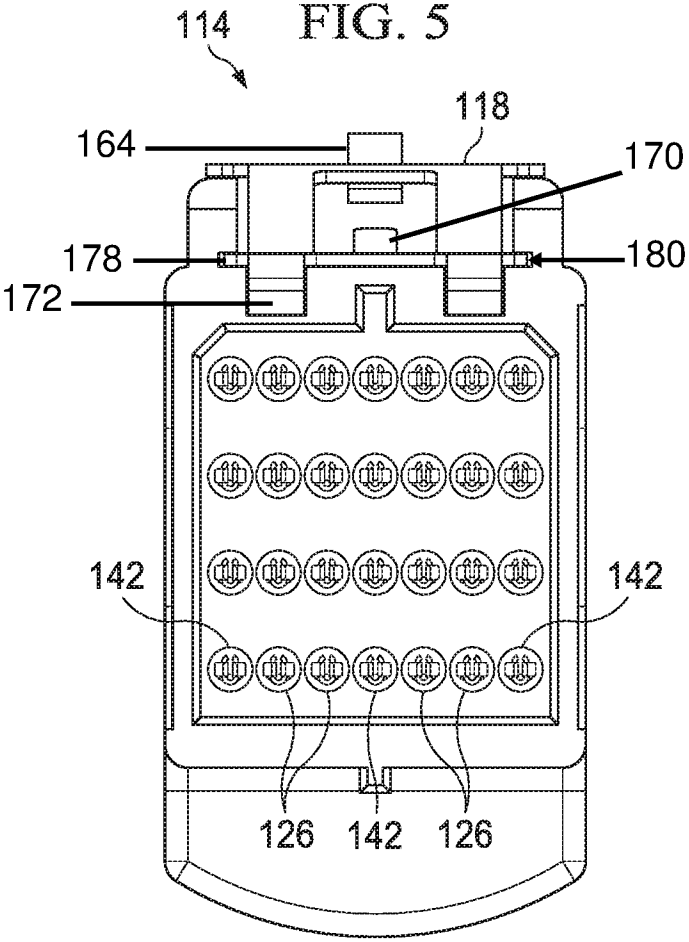
FIG. 5 is a front elevation view of a cable connector.

As shown in at least FIGS. 1 and 2, low-profile right-angle electrical connector assembly 100 comprises six board-mount connectors 102, six cable connectors 114, a PCIe bracket 132, and an EMI shell 134. Those having ordinary skill in the art will understand, of course, that the EMI shell 134 may be replaced with a non-EMI shell or cover as needed in some applications. The six board-mount connectors 102 are housed within EMI shell 134, which is braced by PCIe bracket 132. As shown in FIG. 2, bracket screws 138 pass through holes in EMI shell 134 and low-profile PCIe card 136 and are fastened to PCIe bracket 132 by screwing screws 138 into threaded holes in PCIe bracket 132. The six board-mount connectors 102 are secured to PCIe card 136 by soldering terminals 112 on the board-mount connectors into plated-through holes on PCIe card 136. Board-mount connectors 102 have board-mount contacts 108 and can be either male connectors where board-mount contacts 108 are pin contacts, or board-mount connectors 102 can be female connectors where board-mount contacts 108 are socket contacts (as shown in FIG. 3). Likewise, cable connectors 114 have cable contacts 126 and can be either male connectors where cable contacts 126 are pin contacts (as shown in FIG. 5), or cable connectors 114 can be female connectors where cable contacts 126 are socket contacts.

Low profile PCIe add-in cards are governed by the industry standards set forth in the PCI Express® Card Electromechanical Specification. In particular the standard sets forth height, length, width, and other form factor parameters in the section titled "Add-in Card Form Factors and Implementation."

Figure 8:
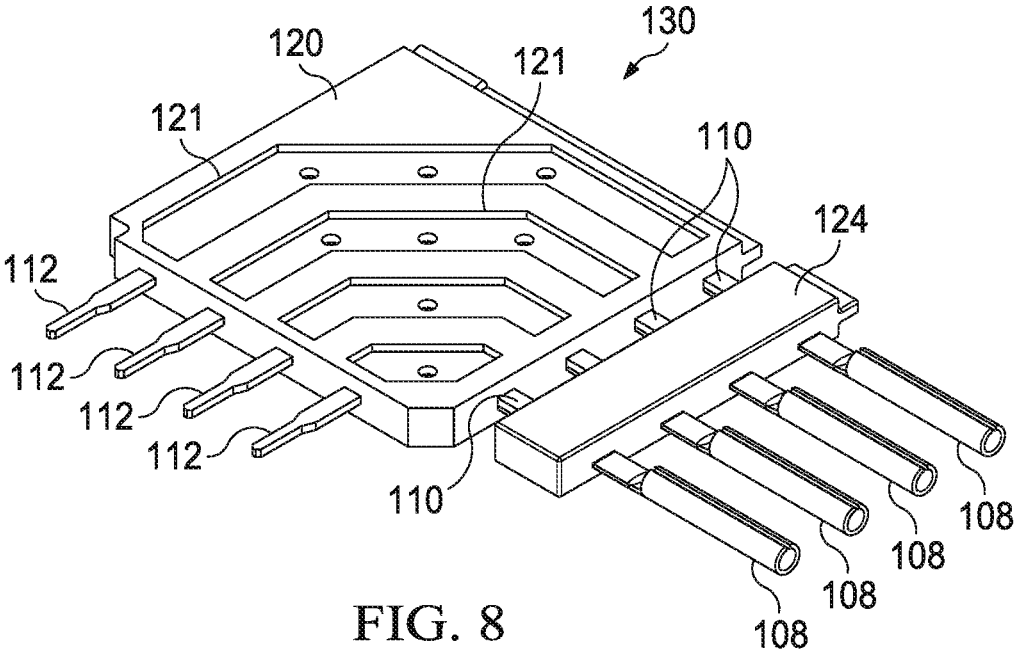
FIG. 8 is a top perspective view of an overmolded lead frame.
Figure 9:
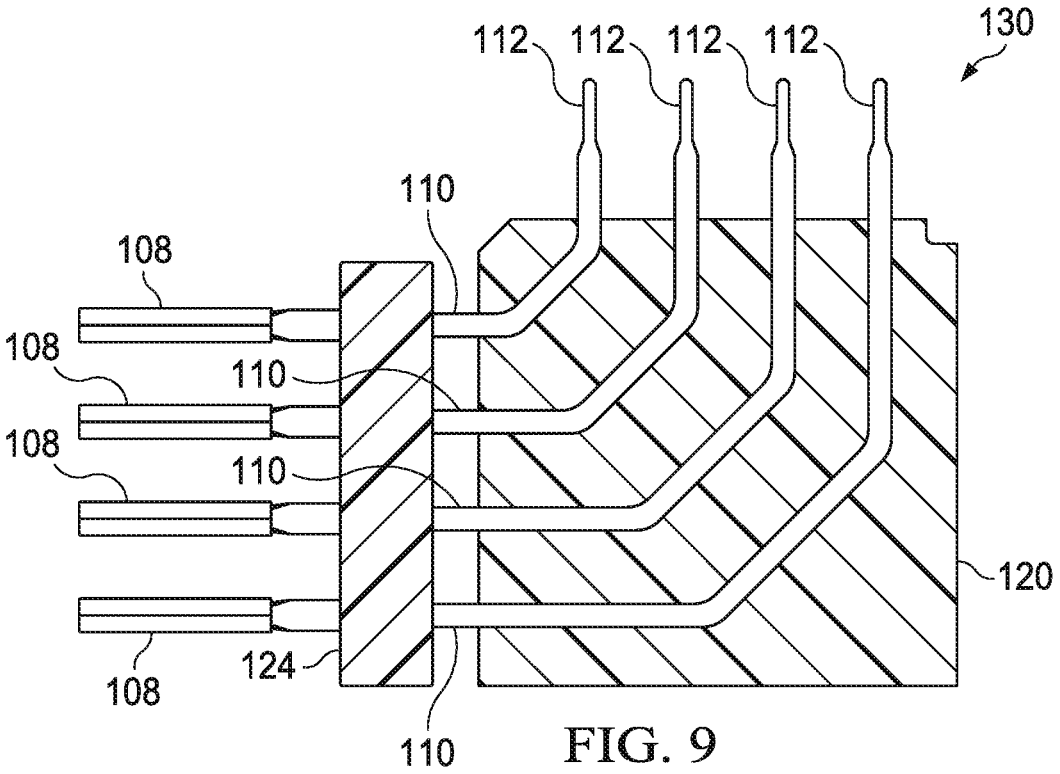
FIG. 9 is a cross-section top elevation view of an overmolded lead frame.

As shown in FIG. 3, each board-mount connector 102 can include an LED 104. Seven lead frame assemblies 130 can be disposed within a housing 106. Each lead frame assembly 130 comprises an overmolded lead frame 120 and either a socket wafer 124 (as shown in FIG. 8) or a pin wafer 128 (not shown), depending on whether board-mount connector 102 is male or female. Each overmolded lead frame 120 has four attachment terminals 112 and four attachment tabs 110. The attachment terminals 112 extend from a side of overmolded lead frame 120 that is perpendicular to the side where the attachment tabs 110 are disposed. In one preferred embodiment, a socket wafer 124 is attached to attachment tabs 110. Extending from socket wafer 124 are four socket contacts 108. Socket contacts 108 are desirably differential pair socket contacts. As shown in at least FIG. 8, each overmolded lead frame 120 features a series of depressions 121. The depressions 121 preferably follow the path of the electrical leads through overmolded lead frame 120. Additionally, depressions 121 create physical air pockets that decrease the effective dielectric constant, thereby increasing the characteristic impedance. Without the air pockets the characteristic impedance would be lower than the desired value (typically 100 Ohms) and the spacing between the lead frames would have to be increased in order to raise the impedance. Thus, the presence of the air pockets allows adjacent overmolded lead frames 120 to be positioned closer together, thereby resulting in a tighter pitch. This tighter pitch contributes toward the compactness of the invention and the ability to utilize this configuration while meeting PCIe low-profile industry standards. Decreasing the effective dielectric constant, thereby increasing impedance, results in the preservation of signal integrity and fidelity while transmitting data at high speeds.

Figure 6:
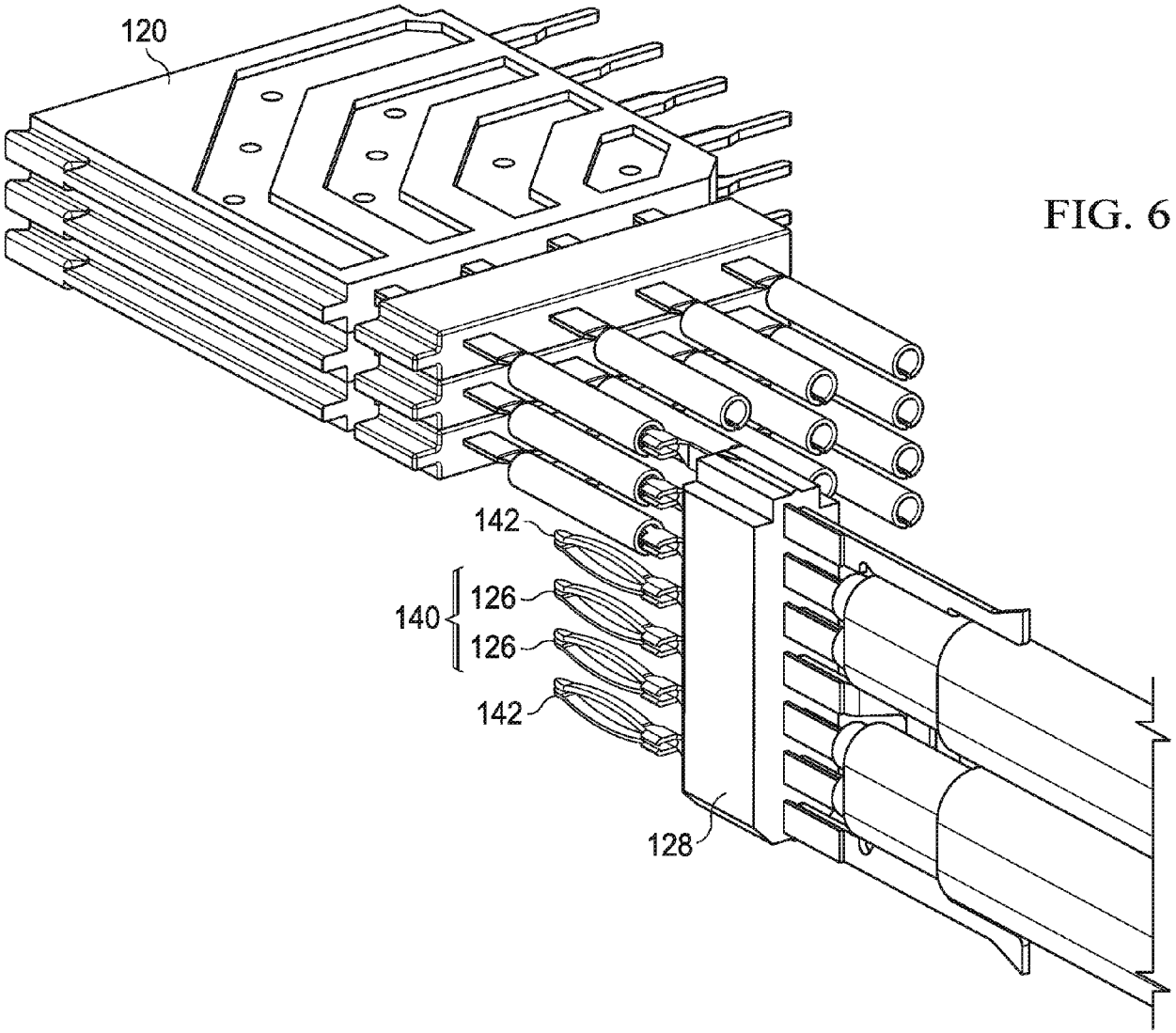
FIG. 6 is a perspective view of a ground strap securing two cable members with the contacts of the cable members and ground strap inserted into three overmolded lead frames.
Figure 7:
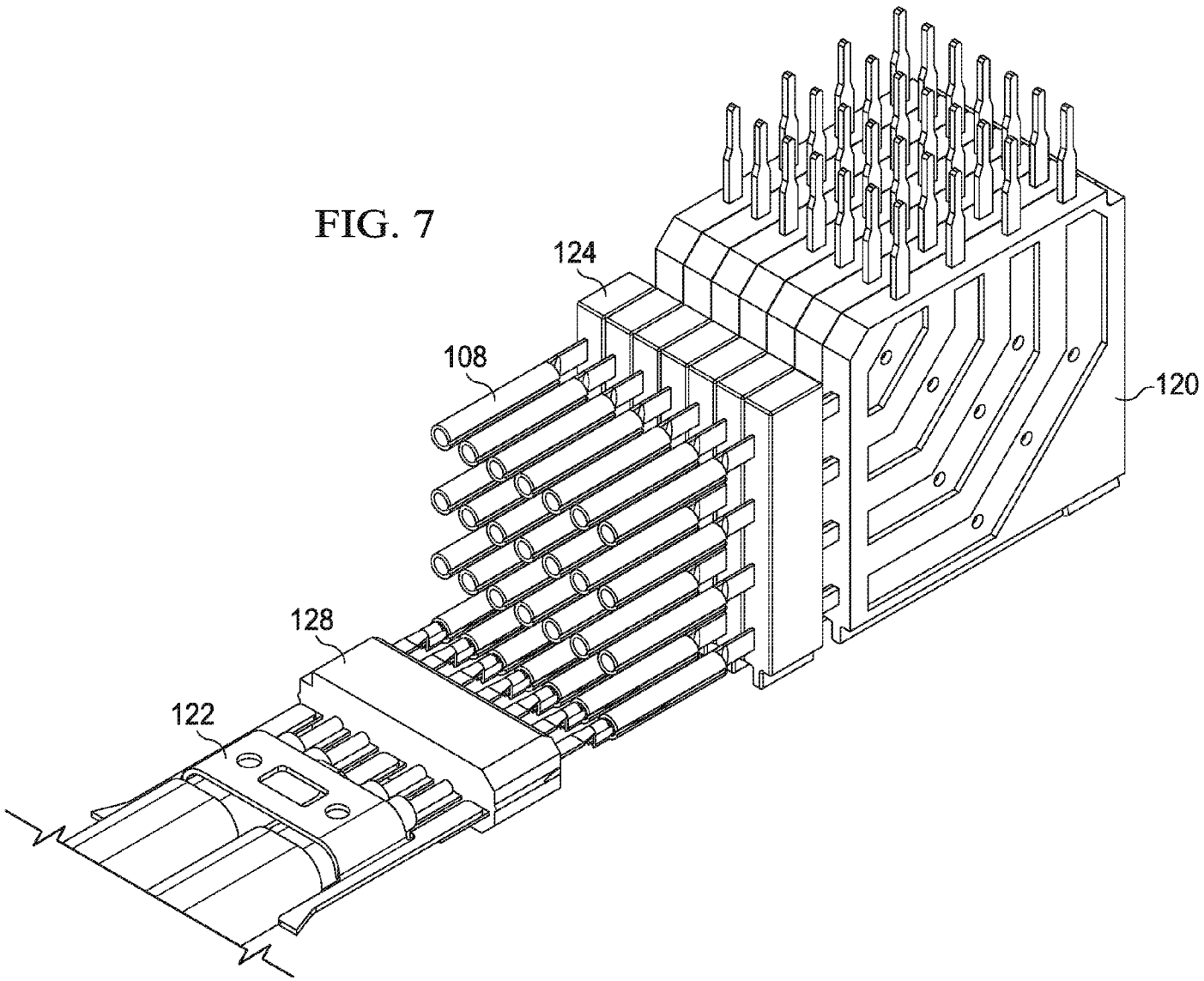
FIG. 7 is a perspective view of a ground strap securing two cable members with the contacts of the cable members and ground strap inserted into seven overmolded lead frames.

As shown in FIG. 3, in one preferred embodiment, each board-mount connector 102 receives a cable connector 114. Cable connector 114 features a latch 118 and houses the terminal ends of cable members 116. Cable members 116 can be twin axial cables. As shown in FIGS. 5 and 6, each cable member 116 terminates in two cable contacts 126. As shown in FIG. 6, cable contacts 126 are desirably differential pair contacts 140. In other words, each cable member 116 terminates in one differential pair 140 of one positive and one negative cable contact 126. As shown in FIG. 3, each cable connector 114 houses the terminal ends (i.e., pair-pins) of eight cable members 116. As shown in FIG. 7, ground strap 122 can secure two cable members 116 together. As shown in FIGS. 5 and 6, ground strap 122 also has three ground pins 142 that separate the differential pairs 140 of each cable member 116. The four cable contacts 126 of both cable members 116 (two pair-pins per cable member) and the three ground pins 142 of ground strap 122 pass through and are secured by pin wafer 128. In the event that lead frame assembly 130 comprises a pin wafer 128, then the four cable contacts 126 of both cable members 116 and the three ground pins 142 of ground strap 122 pass through and are secured by a socket wafer 124.

Figure 4:
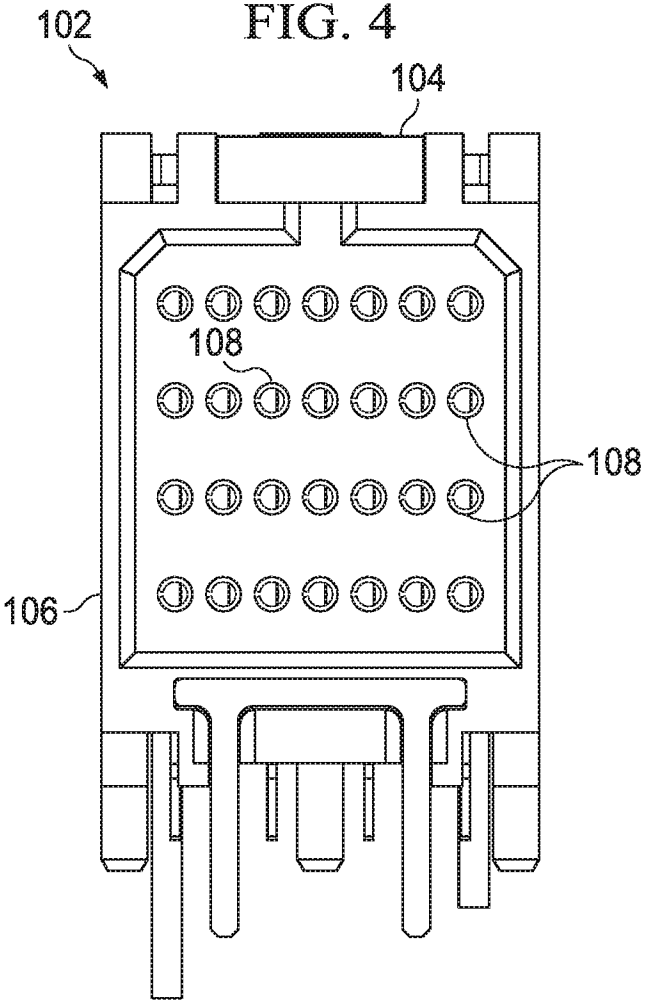
FIG. 4 is a front elevation view of a board-mount connector.

As shown in FIGS. 4 and 5, board-mount connector contacts 108 are adapted to receive cable contacts 126 and ground pins 142. As shown in FIGS. 7 and 8, the attachment tabs 110 of the first, fourth, and seventh overmolded lead frames 120 are designed to receive signals from ground contacts, such as ground pins 142. The attachment tabs 110 of the second and fifth overmolded lead frames 120 are designed to receive signals from positive contacts. The attachment tabs 110 of the third and sixth overmolded lead frames 120 are designed to receive signals from negative contacts.

The electrical connector assembly 100 of the present invention allows for an electrical connection to be made from cable members 116 to a low profile PCIe card 136. A data signal travels from cable members 116 to cable contacts 126 of cable connector 114. The data signal is transmitted from cable contacts 126 to board-mount contacts 108 of board-mount connector 102. The signal is then transmitted to attachment tabs 110 and through overmolded lead frame 120 to attachment terminals 112. Finally, the signal is transmitted from attachment terminals 112 to low profile PCIe card 136.

The present invention provides forty-eight differential pairs for connector assembly 100 by using the six board-mount connectors 102, each of which has eight differential pairs. A low-profile PCIe card with six connectors allows the implementation of multidimensional network topologies that have well-known and documented benefits compared with two-dimensional topologies in terms of latency and scalability. For example, in many applications that use shared memory, the possibility of implementing 3D topology in a standard server can have significant benefits on overall performance. In addition, the use of six connectors containing forty-eight differential pairs allows the implementation of energy proportional computing topologies, like 3D torus, 6D hypercube, Flat Butterfly, and the like in standard server based cluster environments. Specifically, the present invention allows for transmission of six independent concurrent packets with a PHY interface having four lanes that is compliant with the PCIe (Gen 2/3) Specification, Inifniband SDR and DDR PHY Specification, and other protocol PHY specifications, allowing for improved scalability and reduced overall latency.

A connector assembly with only four board-mount connectors and only 32 differential signal pairs can address 4 servers or nodes with the latency of 1 hop, 12 nodes with the latency of 2 hops, 24 nodes with the latency of 3 hops, 40 nodes with the latency of 4 hops, and 60 nodes with the latency of 5 hops. On the other hand, the present invention is able to address 6 servers or nodes with the latency of a single hop, 24 nodes with the latency of 2 hops, 62 nodes with the latency of 3 hops, 128 nodes with the latency of 4 hops, and 230 nodes with the latency of 5 hops. Each additional node addressed adds latency to the operation. While a connector with only four board-mount connectors can address 60 nodes with a latency of 5 hops, the present invention is capable of handling the same number of nodes with the latency of only 3 hops. Thus, the present invention is capable of decreasing the median latency by reducing the number of hops needed to address a given number of nodes as shown in Table 1 below, or alternatively, provide more efficiency or improved scalability at the same latency.

TABLE 1

| 4 connectors | | 6 connectors | |
|---|---|---|---|
| Server/Nodes | Hops | Server/Nodes | Hops |
| 4 | 1 | 6 | 1 |
| 12 | 2 | 24 | 2 |
| 24 | 3 | 62 | 3 |
| 40 | 4 | 128 | 4 |
| 60 | 5 | 230 | 5 |

The fact that datacenter computers rarely operate at full utilization has led to a number of proposals for creating servers that consume energy proportionally to the computations that they are performing. As servers themselves consume energy more proportionally, the datacenter network can more efficiently use cluster power (up to 50%). A datacenter network based on complex multidimensional topology, such as a 3D Torus topology, uses less hardware than a folded-Clos network of equivalent size and performance. This reduction in hardware usage itself results in a more power-efficient network and lower operating expenditures. Accordingly, networks based on complex multidimensional topology, such as a 3D Torus topology, are becoming more prevalent and utilize different protocols such as PCIe and InfiniBand.

Three-dimensional topologies, such as a 3D Torus topology, are orthogonal topologies that map the network on the standard X, Y, Z Cartesian axes. In such a topology, each server is directly connected to six other servers ideally arranged into a physical space in manner that mirrors their logical connection in the network on the standard X, Y, Z Cartesian axes. This arrangement helps to simplify the calculation and the visualization of the network structure. Each axis requires two links, one positive and one negative, and thus, each axis needs two connectors with a total of 16 differential pairs, which translates into a total of six connectors for all three axes. Therefore, a PCIe board would require a total of six connectors to implement a network with a 3D Torus topology (X−, X+, Y−, Y+, Z−, Z+). Each of these connectors must be created with an equal number of differential pairs. The present invention utilizes eight differential pairs for each link and is capable of accommodating a variety of PHY protocols, including Infiniband, 10 Gbit Ethernet PCIe networks, and HyperShare.

A connector assembly with only four connectors containing only 32 differential pairs could not implement a network with a 3D Torus or other three-dimensional network topology. The six connectors required to implement a three-dimensional topology have traditionally been housed in full-size PCIe form-factor cards. These full-size cards do not fit into more popular low-profile, high-density servers. The present invention provides a solution to this issue with a low-profile connector assembly that contains six connectors with 48 differential pairs. Therefore, the present invention allows the introduction of three-dimensional Torus networks and other similar topologies (such as flat butterfly networks) into modern datacenters, where low-profile, high-density servers are used to reduce the servers' physical square footage use.

Stated in other terms, the present invention's use of six connectors provides the ability to implement a three-dimensional grid network topology. A grid network is a type of network system comprising multiple computer systems that are connected to one another in a grid topology. Each computer system serves as a node in the grid topology. In a one-dimensional grid network, the nodes are connected in a loop or a ring. A multi-dimensional grid network is often referred to as a "torus." A connector assembly with four connectors allows for the implementation of a grid network topology where the nodes are connected in two dimensions, and the resulting grid topology can be referred to as a two-dimensional mesh torus. Two connectors correspond to each dimension. An additional two connectors are required to implement a three-dimensional torus. The present invention provides six connectors and thus the ability to implement a three-dimensional torus. Because the present invention provides modular connectors, it can be used with the development of various new grid topologies, such as flat butterfly and hypercube networks.

The present invention provides a connector assembly that is capable of fitting six connectors (each with eight differential pairs) within the low profile PCIe standard bracket. As a result, the present invention provides the ability to use a three-dimensional torus network topology on a high-density server. Currently, other connector assemblies are unable to provide the ability to implement a three-dimensional torus topology on a high-density server. Therefore, the present invention provides improved networking benefits associated with a three-dimensional torus, including higher data transmission rate, lower latency, lower infrastructure costs, lower power consumption, lower operating costs, flexible scalability, simplified cabling, improved fault tolerance, and improved reliability.

Alternative embodiments of the invention achieve the required forty-eight differential signal pairs using different combinations of connectors and differential pairs. For example, one alternative embodiment could contain twelve connectors featuring four differential signal pairs each. As another example, an alternative embodiment could contain three connectors featuring sixteen differential pairs each. As an additional example, an alternative embodiment could contain two connectors featuring twenty-four differential pairs each. In these alternative embodiments the number of cable connectors could be adjusted to match the number of connectors present in the connector assembly.

As alluded to above, in some embodiments, a latch 118 may be provided on each cable connector 114 to help physically secure the cable connector 114 relative to a respective board-mount connector 102. In accordance with the disclosed embodiments, the latch 118 may be removed and replaced as needed, for example, for breakage or wear and tear. Referring back to FIG. 1, in general, the latch 118 is designed to latch or otherwise catch onto the receptacle housing 150 of the EMI shell 134 (or connector cover) and may be made, for example, from a thin sheet of resilient material that imparts a spring-like property to the latch 118. The spring-like property allows the latch 118 to be readily deformed when pressure is applied, then return back substantially to its original shape when the pressure is removed. The types of resilient materials from which the latch 118 may be made may include various metals and metal alloys, for example, stainless steel, Copper-Beryllium, brass, as well as certain types of plastics, and the like. It is of course also possible to spring load the latch 118 in some cases in order to achieve a spring-like property for the latch 118.

As can be seen in FIG. 1, the EMI shell 134 (or connector cover) may include a receptacle housing 150 for receiving the cable connectors 114, and the latch 118 of each cable connector 114 may latch onto the receptacle housing 150. Such a receptacle housing 150 may be made of an electrically conductive material where the EMI shell 134 is used, or it may be made of an electrically nonconductive material where a connector cover is used instead of the EMI shell 134. In either case, the receptacle housing 150 may be formed in some embodiments as an integral extension of the EMI shell 134. Alternatively, the receptacle housing 150 of the EMI shell 134 may be provided as a discrete component that may then be attached to the EMI shell 134 in a manner known to those having ordinary skill in the art (e.g., soldered, etc.). Similarly, in some embodiments, the receptacle housing 150 of the EMI shell 134 may be a unitary receptacle that is sized and shaped to receive up to six cable connectors 114, as depicted in FIG. 1, or it may be composed of several (e.g., two, three, four, five, six, seven, eight, nine, ten, etc.) individual receptacles disposed adjacent one another, each receptacle configured to receive one cable connector 114.

Figure 10:
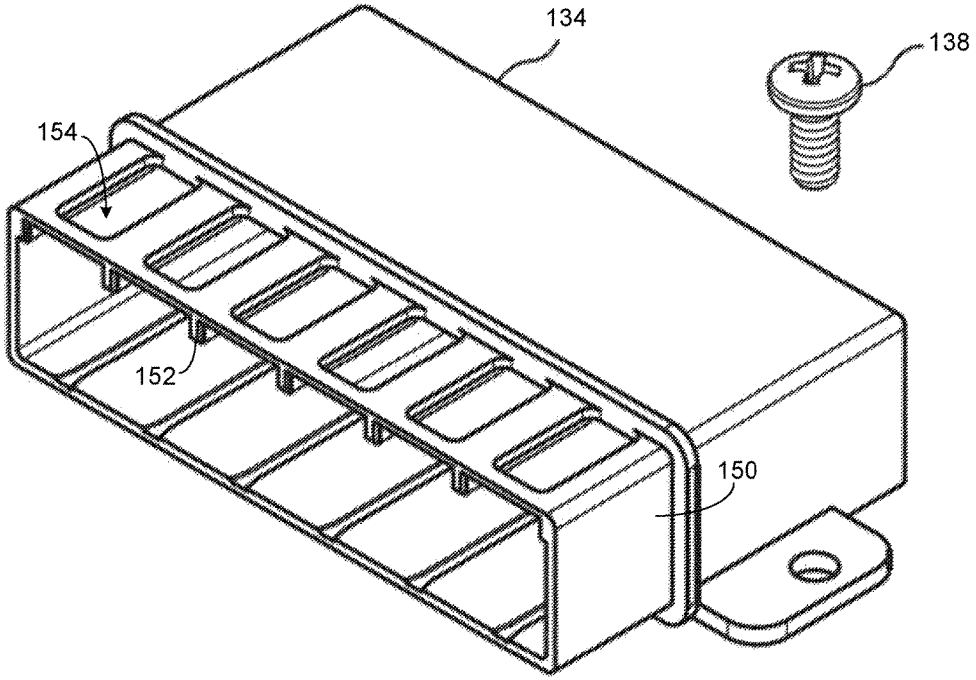
FIG. 10 is a close up perspective view of a board-mount connector shell or cover of the low-profile right-angle connector assembly.

As shown more clearly in FIG. 2 and FIG. 10, in some embodiments, the receptacle housing 150 of the EMI shell 134 may include a plurality of spaced apart connector guides 152 that help position the cable connectors 114 as they are inserted into the board-mount connectors 102. The connector guides 152 may extend a predefined distance from the top inner surface of the receptacle housing 150 down toward the bottom inner surface of the receptacle housing 150 and may, or may not, touch the bottom inner surface of the receptacle housing 150. Latch openings 154 may then be formed in the top wall of the receptacle housing 150 for engaging the latches 118 of the cable connectors 114 as they are inserted into the board-mount connectors 102. The latch openings 154 may be formed in the receptacle housing 150 using any method known to those having ordinary skill in the art, such as by cutting, stamping, punching, die casting, and the like, and may be sized and shaped as needed to effectively engage the latches 118 of the cable connectors 114. In the embodiment shown, there may be six latch openings 154 in the receptacle housing 150, one latch opening 154 for each latch 118 for up to six cable connectors 114.

Figure 11:
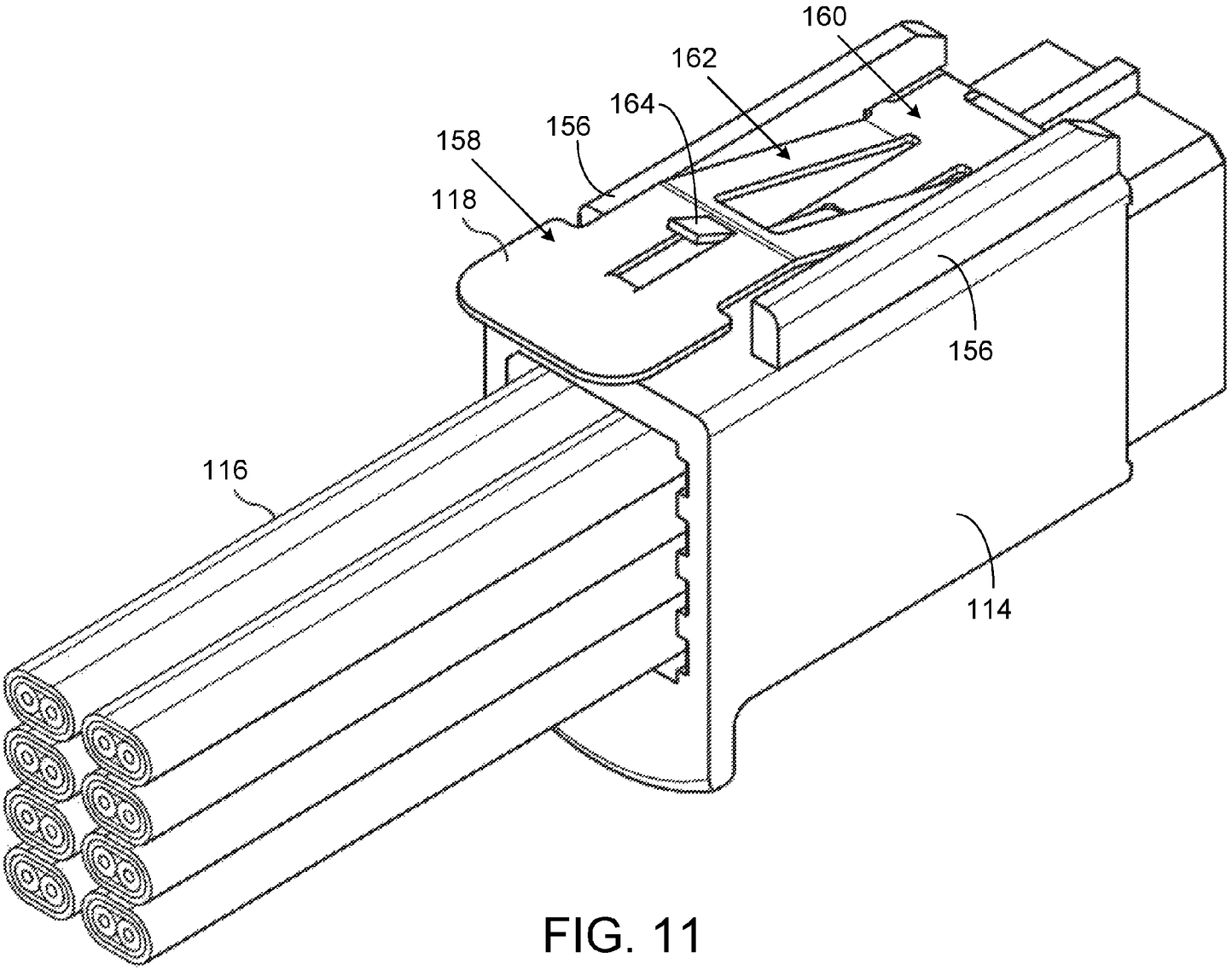
FIG. 11 is close up perspective view of a cable connector and latch of the low-profile right-angle connector assembly.

A more detailed view of an exemplary latch 118 may be seen in FIGS. 3 and 11 according to the disclosed embodiments. In some embodiments, the latch 118 may be mounted or otherwise disposed lengthwise between two longitudinally extending ridges 156 formed parallel to one another on the top of the cable connector 114. The ridges 156 may be spaced apart a predefined distance so as to provide enough space for receiving the latch 118 lengthwise therebetween, and each ridge 156 may have a predefined width such that for each cable connector 114, both ridges 156 just fit between the same two adjacent connector guides 152 of the receptacle housing 150 (given real-world manufacturing tolerances), resulting in precise and controlled insertion of the cable connector 114 in the corresponding board-mount connector 102. Those having ordinary skill in the art will understand, of course, that the degree of precision here and throughout the present disclosure is subject to real-world manufacturing capabilities and tolerances. In some embodiments, the ridges 156 may be chamfered on one or more sides (not specifically referenced) to help facilitate insertion of the cable connector 114 into the receptacle housing 150.

As can be seen in FIG. 11, the exemplary latch 118 may generally be composed of three main sections: a top or head section 158, a bottom or base section 160, and a body section 162 connecting the head section 158 and the base section 160. When mounted or otherwise disposed on the cable connector 114, the head section 158 of the latch 118 is elevated relative to the cable connector 114 and is generally even with the top of the ridges 156, while the base section 160 of the latch 118 rests on the cable connector 114, and the body section 162 extends diagonally therebetween.

A latch stop 164 may be provided in some embodiments that protrudes up from the head section 158 of the latch 118. Such a latch stop 164 is designed to catch the leading edge of the latch opening 154 in the receptacle housing 150 when the cable connector 114 is connected to the board-mount connector 102, thereby preventing the latch 118, and hence the cable connector 114, from becoming inadvertently unplugged from the board-mount connector 102. In some embodiments, the latch stop 164 may be formed by partially punching a geometric shape, such as a square, circle, or the like, from the head section 158 so that only a portion (e.g., half, three quarters, etc.) of the geometric shape pokes out from the head section 158. Other shapes for the latch stop 164 may of course be used, such as the rectangular-shaped latch stop 164 shown in FIG. 11 or the hemispherical or ovoid-shaped latch stop 164 depicted in FIG. 12, without departing from the scope of the disclosed embodiments.

Figure 13A:
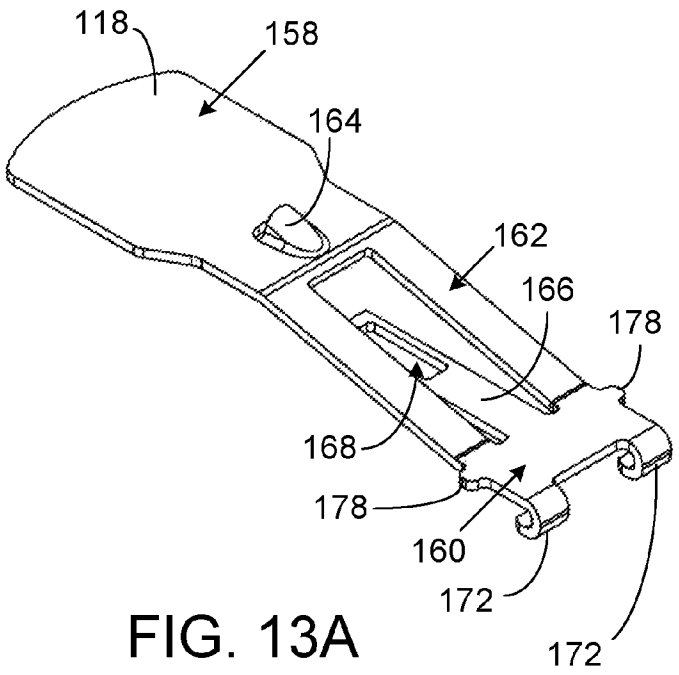
FIGS. 13A-13C are perspective, top, and side views, respectively, of a removable latch for the cable connector.
Figure 13B:
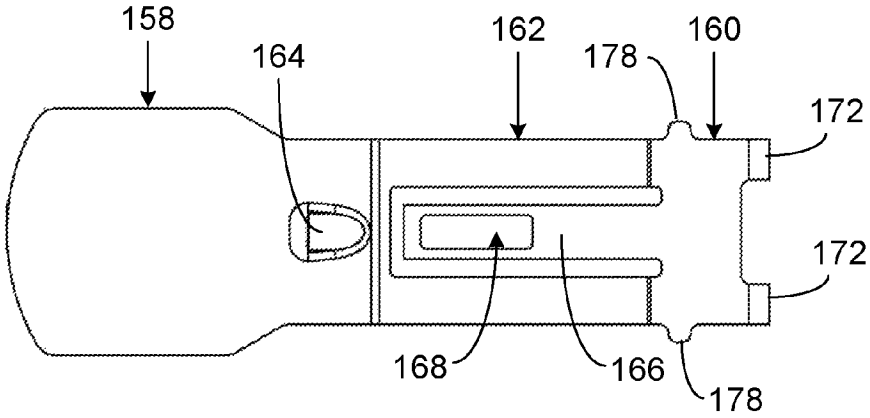
Figure 13C:
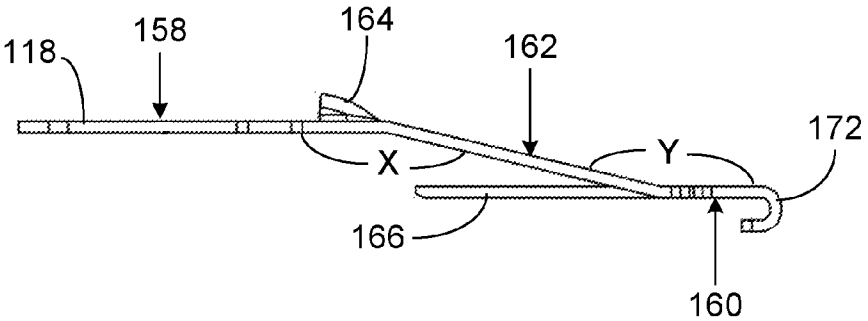

FIGS. 13A-13C illustrate a perspective view, top view, and side view, respectively, of the various sections of the latch 118 in more detail according to the disclosed embodiments. As mentioned earlier, the latch 118 may generally be cut, stamped, punched, or the like, from a thin sheet of resilient material, such as metal, metal alloy, plastic, and the like, that imparts a spring-like property to the latch 118. Depending on the particular application, the latch 118 may be flat, curved, or it may be flat with one or more bends therein. An example of the latter case can be seen in FIG. 13C, where there is a bend of a predefined angle X between the head section 158 and the body section 162, and another bend of a predefined angle Y between the body section 162 and the base section 160. The predefined angles X and Y may be selected as needed by those having ordinary skill in the art to suit a particular application, but in one embodiment, the predefined angles are chosen so that the head section 158 and the base section 160 are generally parallel to one another while the body section 162 forms an interconnecting diagonal therebetween.

As depicted in FIGS. 13A-13C, one of several attachment mechanisms may be provided on the latch 118 to help secure the latch 118 to the cable connector 114 in a removable manner. In one embodiment, the attachment mechanisms may include an anchor tab 166 on the body section 162 of the latch 118 formed by partially cutting or punching through a geometric shape, such as a rectangle, so that the anchor tab 166 is generally parallel with the head section 158 and the base section 160. Such an anchor tab 166 may then be used to secure the latch 118 in place and help prevent unwanted movement of the latch 118 back and forth and side to side. To this end, the anchor tab 166 may be provided with an anchor opening 168 that may be lowered over and around a stump-like latch anchor 170 protruding from the top surface of the cable connector 114 (see FIG. 12). Such an anchor opening 168 may have approximately the same size and shape as the outline of the latch anchor 168 when viewed from above (i.e., plan view), resulting in a flush or precise fit for the anchor opening 168 around the latch anchor 170 when the anchor opening 168 is lowered over the latch anchor 170 (keeping in mind real-world manufacturing capabilities and tolerances) to thereby hold the latch 118 in proper position on the cable connector 114.

Figure 14B:
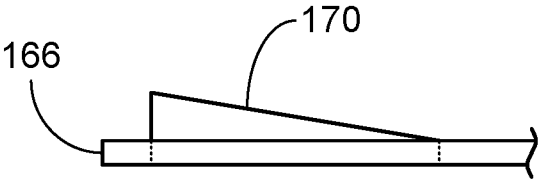
FIGS. 14A-14C are exemplary latch anchors that may be provided on the cable connector.
Figure 14A:
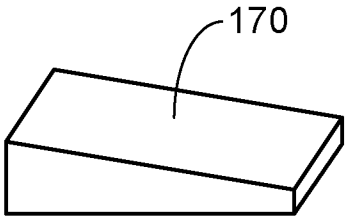
Figure 14C:
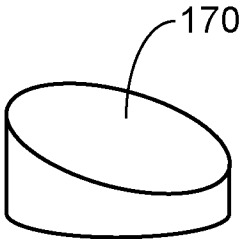

Examples of the latch anchor 170 are illustrated in FIGS. 14A-14C. As can be seen in FIG. 14A, in one embodiment, the latch anchor 170 may have a wedge-like shape that allows the anchor opening 168 of the anchor tab 166 to slide up the inclined face of the wedge-like latch anchor 170 and then drop down around the latch anchor 170. This is depicted in FIG. 14B, which is a side view of the anchor tab 166 disposed over and around the latch anchor 170 and thus held substantially immovable by the latch anchor 170. FIG. 14C illustrates another, different implementation of the latch anchor 170, this one having a generally circular shape. Other latch anchor 170 implementations may be contrived by those having ordinary skill in the art without departing from the scope of the disclosed embodiments. For example, it is possible to have a latch anchor 170 that is the same height all the way around, in which case the anchor opening 168 would need to be lowered in place around the latch anchor 170 instead of sliding up and dropping down around it.

Figure 15:
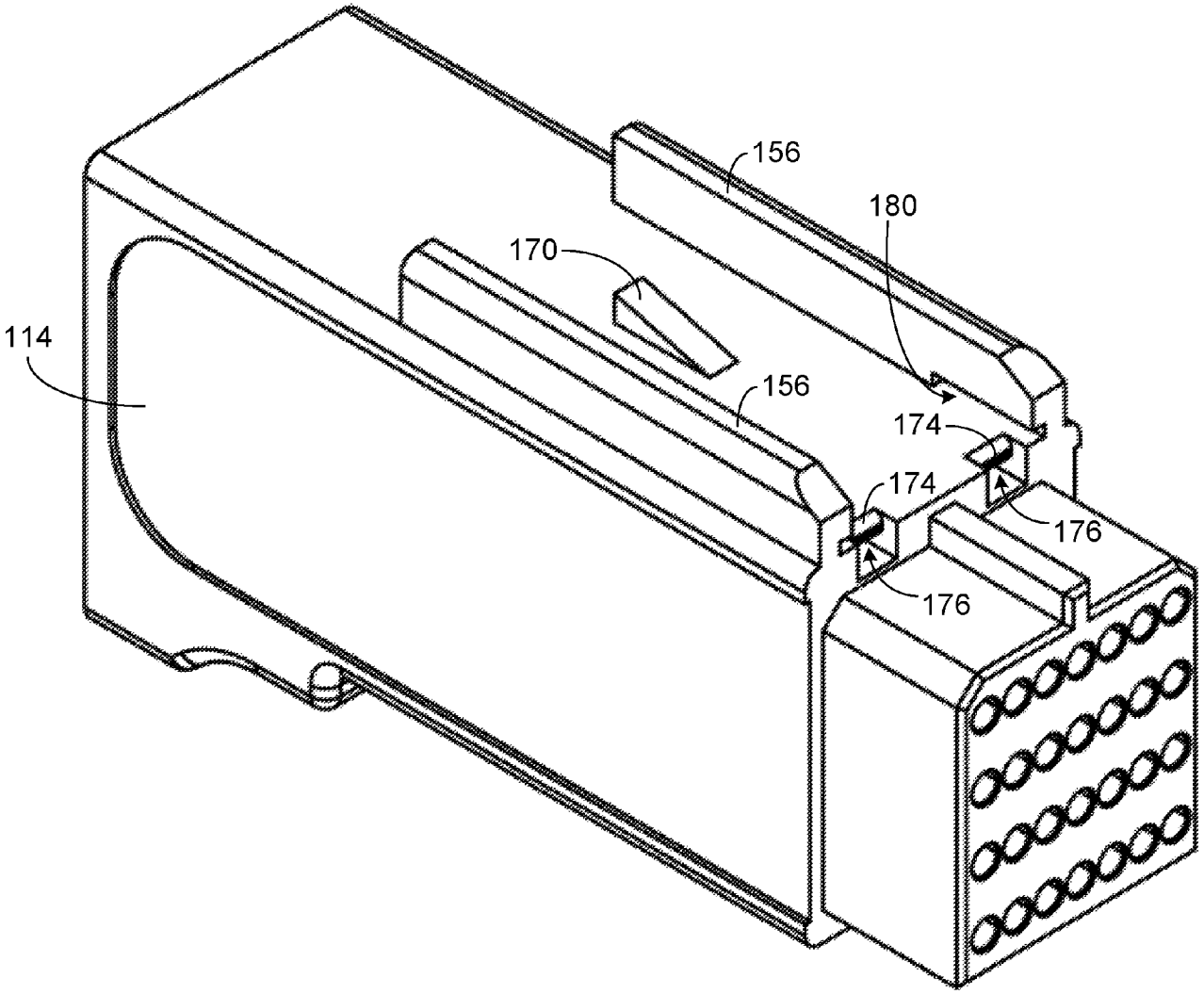
FIG. 15 is close up perspective view of a cable connector of the low-profile right-angle connector assembly with the latch removed from the connector body.

A close or precise fit between the anchor opening 168 and the latch anchor 170 is not necessary for all implementations. In some embodiments, for example, the latch anchor 170 may have a fully extending ramp on the side proximal to the base section 160, as shown in FIG. 15, to allow the anchor tab 166 to more easily slide up and over the latch anchor 170 (i.e., without the initial ledge of the wedge-like latch anchor 170 above). In such embodiments, the latch anchor 170 prevents the latch 118 from sliding back toward the base section 160, but it may be necessary to provide an additional attachment mechanism to prevent the latch 118 from sliding forward toward the head section 158.

Referring again to FIGS. 13A-13C, in some embodiments, the additional attachment mechanism may be provided in the form of one or more hooks 172, which may be semicircular, extending from the base section 160 at the end of the latch 118. The one or more semicircular hooks 172 may then be snapped onto or otherwise engaged with one or more rounded or semi-cylindrical hook supports 174 provided in the cable connector 114, as shown in FIG. 15, to secure the latch 118 against movement in the direction toward the head section 158. Naturally, the number of hook supports 174 present, which is two in the embodiment of FIG. 15, corresponds to the number of semicircular hooks 172 provided. Although not necessary, in some embodiments, each of the hook supports 174 may be formed within a pocket area 176 in the cable connector 114 that may be sized and shaped (e.g., cuboid) to help guide the snapping thereon of the semicircular hooks 172 during assembly.

Referring still to FIGS. 13A-13C, in some embodiments, in addition to, or instead of, the semicircular hooks, one or more latch guides 178 may be provided on the sides of the base section 160 as an attachment mechanism. The one or more latch guides 178 may then be fitted into and slid along one or more slots 180 formed in the ridges 156 of the cable connector 114, as shown in FIG. 15, to limit the movement of the latch 118 in toward the head section 158. The one or more longitudinal guides (and the one or more semicircular hooks 172 as well) also help to retain the latch 118 on the cable connector 114 by keeping the latch 118 from coming up off the cable connector 114.

Figure 12:
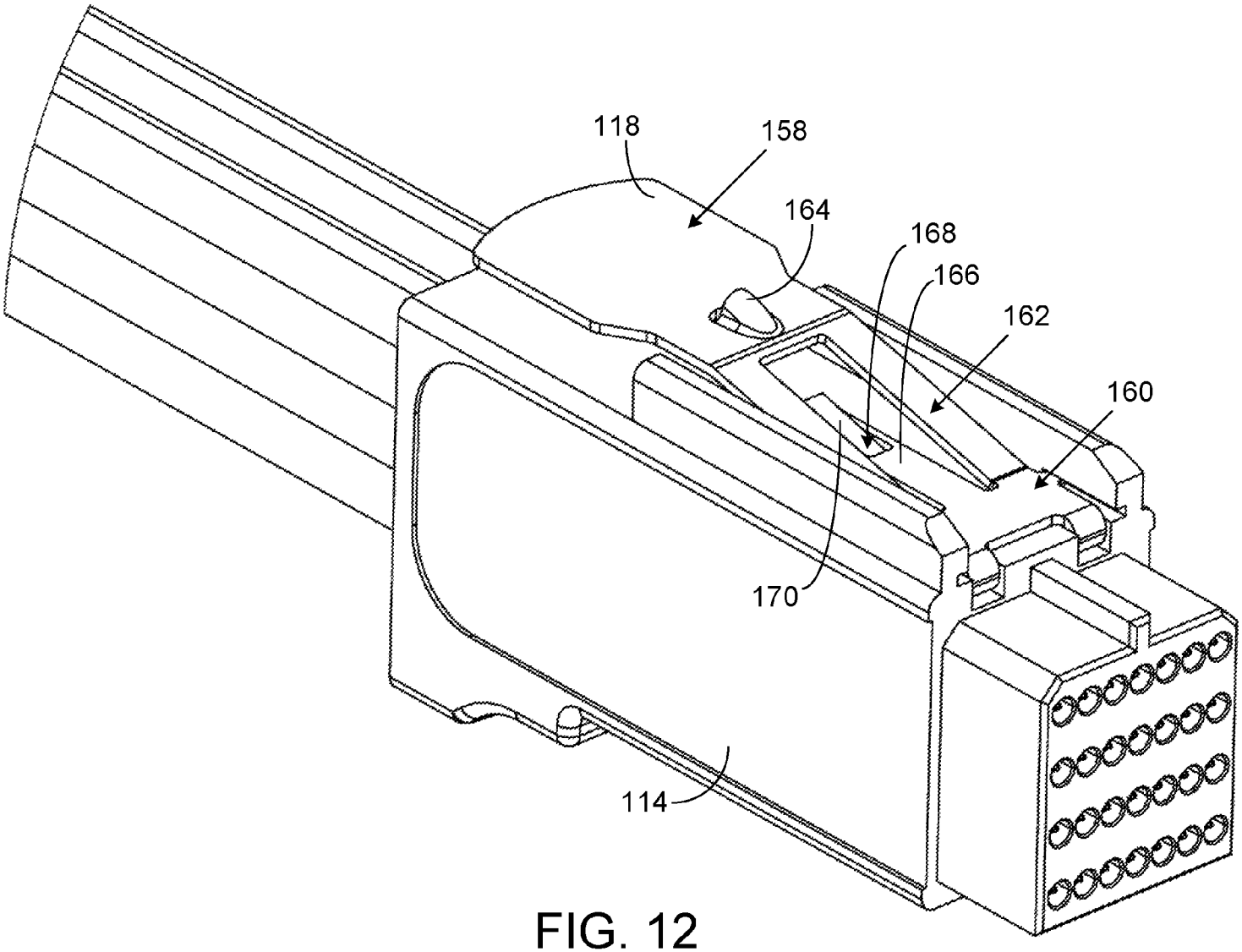
FIG. 12 is close up perspective view of another cable connector and latch of the low-profile right-angle connector assembly.

A fully assembled cable connector 114 and latch 118 having the features described above may be seen in FIG. 12. To remove the latch 118 from the cable connector 114, for example, due to breakage or wear and tear, one of ordinary skill in the art may use a small flathead screwdriver or similar implement to lever or otherwise lift the anchor tab 166 up off the latch anchor 170 and thereafter slide the latch 118 off the cable connector 114 in the direction of the base section 160. Note that the embodiment of FIG. 12 is exemplary only, and that one or more of the features described above may be modified or omitted entirely, depending on the particular applications, manufacturing techniques and tolerances used, types of materials employed, and the like without departing from the scope of the disclosed embodiments.

Figure 16:
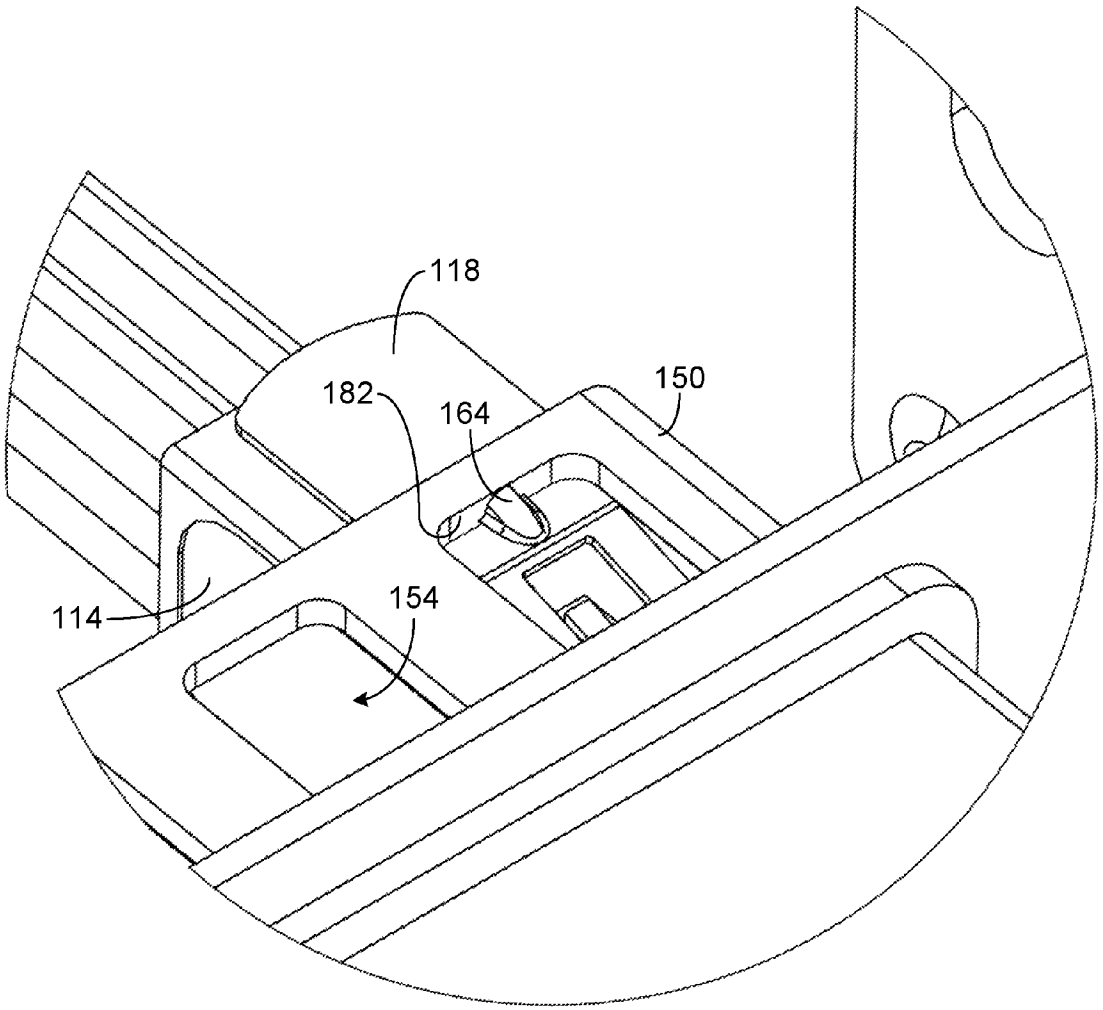
FIG. 16 is a close up perspective view of a cable connector and latch removably engaged with a receptacle housing of a board-mount connector shell or cover.

FIG. 16 illustrates the assembled cable connector 114 and latch 118 engaged within the latch opening 154 of the receptacle housing 150. As can be seen, when engaged in this manner, the latch stop 164 abuts against the leading edge 182 of the latch opening 154 to prevent the cable connector 114 from being inadvertently pulled out. Depressing the head section 158 of the latch 118 releases the latch stop 164 from the latch opening 154 and allows the cable connector 114 to be unplugged from the board-mount connector 102.

The invention has been described in the context of preferred and other embodiments and not every embodiment of the invention has been described. Obvious modifications and alterations to the described embodiments are available to those of ordinary skill in the art. The disclosed and undisclosed embodiments are not intended to limit or restrict the scope or applicability of the invention conceived of by the Applicants, but rather, in conformity with the patent laws, Applicants intend to protect fully all such modifications and improvements.

The invention claimed is:

1. An electrical connector assembly, comprising:

a board-mount connector having one or more differential signal pairs, each differential signal pair comprising a pair of signal contacts configured to transmit differential signals;

a cable connector configured to be detachably coupled to the board-mount connector;

an EMI shell substantially enclosing the board-mount connector, the EMI shell having a receptacle housing configured to receive the cable connector; and a latch attached to the cable connector, the latch configured to releasably engage the receptacle housing of the EMI shell;

wherein the cable connector includes a latch anchor protruding from a top surface of the cable connector and the latch includes an anchor tab, the anchor tab configured to engage the latch anchor to releasably secure the latch on the cable connector, said anchor tab having an anchor opening formed therein that is sized and shaped to fit substantially flush around the latch anchor and thereby prevent movement of the latch back and forth and side to side on the cable connector;

wherein the differential signal pairs are socket contacts.

2. The electrical connector assembly according to claim 1, wherein the receptacle housing of the EMI shell includes a latch opening and the latch includes a latch stop configured to engage a side of the latch opening.

3. The electrical connector assembly according to claim 1, further comprising a PCIe bracket bracing the EMI shell.

4. The electrical connector assembly according to claim 1, wherein the cable connector includes one or more slots and the latch includes one or more guide tabs configured to engage the one or more of slots to releasably secure the latch on the cable connector.

5. The electrical connector assembly according to claim 1, wherein the latch is removably attached to the cable connector.

6. The electrical connector assembly according to claim 1, wherein the differential signal pairs are pin contacts.

7. An electrical connector assembly, comprising:

a board-mount connector having one or more differential signal pairs, each differential signal pair comprising a pair of signal contacts configured to transmit differential signals;

a cable connector configured to be detachably coupled to the board-mount connector;

an EMI shell substantially enclosing the board-mount connector, the EMI shell having a receptacle housing configured to receive the cable connector; and a latch attached to the cable connector, the latch configured to releasably engage the receptacle housing of the EMI shell;

wherein the cable connector includes a latch anchor protruding from a top surface of the cable connector and the latch includes an anchor tab, the anchor tab configured to engage the latch anchor to releasably secure the latch on the cable connector, said anchor tab having an anchor opening formed therein that is sized and shaped to fit substantially flush around the latch anchor and thereby prevent movement of the latch back and forth and side to side on the cable connector;

wherein the cable connector comprises seven overmolded lead frame assemblies.

8. The electrical connector assembly according to claim 7, wherein each one of the overmolded lead frame assemblies comprises a lead frame and a pin wafer or a socket wafer.

9. An electrical connector assembly, comprising:

a board-mount connector having one or more differential signal pairs, each differential signal pair comprising a pair of signal contacts configured to transmit differential signals;

a cable connector configured to be detachably coupled to the board-mount connector;

an EMI shell substantially enclosing the board-mount connector, the EMI shell having a receptacle housing configured to receive the cable connector; and a latch attached to the cable connector, the latch configured to releasably engage the receptacle housing of the EMI shell;

wherein the cable connector includes a latch anchor protruding from a top surface of the cable connector and the latch includes an anchor tab, the anchor tab configured to engage the latch anchor to releasably secure the latch on the cable connector, said anchor tab having an anchor opening formed therein that is sized and shaped to fit substantially flush around the latch anchor and thereby prevent movement of the latch back and forth and side to side on the cable connector;

wherein the board-mount connector has eight differential signal pairs.

* * * * *